US005619311A

United States Patent [19]

Kurokawa et al.

[11] Patent Number: 5,619,311

[45] Date of Patent: *Apr. 8, 1997

[54] ROLLER CHARGING APPARATUS AND IMAGE FORMING APPARATUS USING THE SAME

[75] Inventors: Junji Kurokawa; Toshio Nakahara, both of Yokohama; Norimasa Soumiya, Souka, all of Japan

[73] Assignee: Ricoh Company, Ltd., Tokyo, Japan

[ * ] Notice: The term of this patent shall not extend beyond the expiration date of Pat. No. 5,499,078.

[21] Appl. No.: 251,363

[22] Filed: May 31, 1994

[30] Foreign Application Priority Data

| | | | |
|---|---|---|---|
| May 31, 1993 | [JP] | Japan | 5-154482 |
| May 31, 1993 | [JP] | Japan | 5-154483 |
| May 31, 1993 | [JP] | Japan | 5-154484 |
| May 24, 1994 | [JP] | Japan | 6-132500 |

[51] Int. Cl.[6] ..... G03G 15/02

[52] U.S. Cl. ..... 399/176; 361/225; 399/100

[58] Field of Search ..... 355/219, 274, 355/275, 212; 361/220–225, 230, 232–234; 430/920, 937, 55, 902; 492/53, 54, 56; 428/466, 906

[56] References Cited

U.S. PATENT DOCUMENTS

| | | | |
|---|---|---|---|
| 4,727,453 | 2/1988 | Ewing | 361/225 |
| 4,967,231 | 10/1990 | Hosoya et al. | 355/219 |
| 5,089,851 | 2/1992 | Tanaka et al. | 355/219 |
| 5,146,281 | 9/1992 | Kisu | 355/219 |
| 5,312,662 | 5/1994 | Ohta et al. | 492/53 X |
| 5,342,717 | 8/1994 | Su et al. | 430/937 X |
| 5,479,243 | 12/1995 | Kurokawa et al. | 355/219 |
| 5,497,219 | 3/1996 | Kurokawa et al. | 355/219 |
| 5,499,078 | 3/1996 | Kurokawa et al. | 355/219 X |

FOREIGN PATENT DOCUMENTS

| | | |
|---|---|---|
| 0510643 | 10/1992 | European Pat. Off. . |
| 0515164 | 11/1992 | European Pat. Off. . |
| 0534437 | 3/1993 | European Pat. Off. . |
| 58-142368 | 8/1983 | Japan . |
| 58-194061 | 11/1983 | Japan . |
| 63-149668 | 6/1988 | Japan . |
| 63-208878 | 8/1988 | Japan . |
| 1-277257 | 11/1989 | Japan . |
| 3-200191 | 9/1991 | Japan . |

*Primary Examiner*—Shuk Yin Lee

*Attorney, Agent, or Firm*—Oblon, Spivak, McClelland, Maier & Neustadt, P.C.

[57] ABSTRACT

In the roller charging apparatus according to the present invention, the charging roller includes a layer of an epichlorohydrin rubber, so that it is possible to eliminate electric nonuniformity of a conductive elastic layer and to be charged by loading only a DC voltage. The charging roller also may have a surface layer formed of polyamide resin or fluorine resin. In addition durability can be improved by setting the roller hardness of the charging roller to 42 (measured by a JISA hardness meter) or more. Further, a roller diameter $D_r$ of the charging roller and drum diameter $D_d$ of the photosensitive drum may satisfy the relation of $D_d/D_r \geqq 4$. A cleaner can also be provided for removing foreign materials, such as toner, from the charging roller, and the cleaner may have a rubber hardness less than that of the charging roller.

33 Claims, 10 Drawing Sheets

ROLLER CHARGING APPARATUS AND IMAGE FORMING APPARATUS USING THE SAME

FIELD OF THE INVENTION

The present invention relates to a roller charging apparatus which loads a DC current to a charging roller contacting a drum-formed or a belt-formed photosensitive element and rotating in association with movement of the photosensitive element to homogeneously electrify the entire surface of the photosensitive element, a roller charging apparatus comprising at least a charging roller contacting a photosensitive drum and rotating in association with movement of the photosensitive element and a cleaning blade to remove foreign materials, such as toner, deposited on the surface of the charging roller, and an image forming apparatus using the same.

BACKGROUND OF THE INVENTION

As a charging apparatus for homogeneously charging an entire surface of a photosensitive element in an image forming apparatus based on an electronic photograph system, a corona discharger has been widely used. Although this corona discharger is effective as a means for homogeneously charging a photosensitive element to a certain level of voltage, a high voltage power supply unit is required in processing for electrification by means of corona discharge, and a large quantity of ozone is generated in association with the discharge. When a large quantity of ozone is generated, it gives bad effects over environment, and sometimes charging members and a photosensitive element are disadvantageously deteriorated by ozone.

In contrast to the corona discharger as described above, and with reference to FIG. 18, a charging roller which electrifies a surface of a photosensitive drum 702 by causing a charging roller 701 to contact a photosensitive drum 702 and rotate in association with movement of the photosensitive drum to load a voltage from a power supply unit 704 to a core metal 703 of the charging roller 701 has been put into practical use as shown in FIG. 18. This charging roller 701 as a charging means makes it possible to use a low voltage power supply unit, and also a quantity of ozone generated in association with a processing for electrification is advantageously reduced. Also absorption of dust due to static electricity generated in association with use of a corona electrode wire does not occur, and advantageously a high voltage power supply unit is not required.

However, with a charging roller, often unevenness in electrification may easily occur, and in addition a static voltage in an electrified area may largely and disadvantageously fluctuate due to changes in environmental conditions, and as far as the homogeneity in electrification is concerned, capability of the charging roller is substantially lower as compared to that of a corona discharger.

To solve the problems as described above, Japanese Patent Laid-Open Publication No. 63-149668 discloses the "contact electrification system", in which homogeneity in electrification can largely be improved by superimposing AC voltages each having an inter-peak voltage two times or more higher than the electrification start voltage ($V_{TH}$) when AD current is loaded.

Also as an apparatus for removing toner deposited on a charging roller, there is, for instance, the "roller charging apparatus" disclosed in Japanese Patent Laid-Open Publication No. 58-194061. In this apparatus, a cleaning element is provided adjacent to a surface of a charging roller comprising a conductive elastic element, and also deposition of toner on the surface of the charging roller is prevented by coating the surface of the conductive elastic element with a non-conductive coating.

However, in the "contact electrification system" disclosed in Japanese Patent Laid-Open publication No. 63-149668 cited above, as AC voltages each having an inter-peak voltage two times or more higher than an electrification start voltage ($V_{TH}$) when DC voltage is loaded are superimposed, so that, in addition to a DC power supply unit, an AC power supply unit is required, which results in an increase of cost of the apparatus itself, and furthermore a large quantity of AC current not contributing to an electric charge of a photosensitive element is consumed, and in association with it not only the power cost increases, but a large quantity of ozone is generated. As a result, charging members and the photosensitive member are deteriorated, and furthermore environmental pollution may sometimes disadvantageously occur. In addition the substantial durability is rather poor.

For this reason, a charging roller using synthetic rubber (epichlorohydrin rubber) having a medium degree of resistance in the elastic layer was proposed by the present inventor so that a voltage could be loaded to the charging roller not using an AC power supply unit, and using only a DC power supply unit. The present inventor investigated a cause for the fact that uneven electrification is generated only when a DC voltage is loaded and found that uneven electrification is caused by the elastic layer which is a synthetic rubber/carbon distributed layer, namely that uneven electrification is caused by electric nonuniformity of the conductive elastic layer due to distribution fault of carbon and synthetic rubber, and proposed the invention so that uneven electrification generated only when a DC voltage is loaded would be eliminated by replacing a carbon/synthetic rubber elastic layer of a charging roller with a synthetic rubber (epichlorohydrin rubber) having a medium degree of resistance.

Also withstand voltage of a roller layer becomes critical when only a DC voltage is loaded, but when the epichlorohydrin rubber having a medium degree of resistance is used for the elastic layer, the withstand voltage is substantially improved as compared to that of a conventional type of conductive elastic layer based on a carbon/synthetic rubber system. Furthermore, rubber hardness of the epichlorohydrin rubber is relatively high, 40 (JISA), and the distortion and deformation due to the elasticity are low, so that the mechanical strength is excellent.

However, even if the charging roller having the excellent electric and mechanical characteristics described above which can homogeneously be electrified when only a DC voltage is loaded, the durability as that of a roller charging apparatus may sometimes be low in some copiers in which the roller charging apparatus is used.

Concretely when used in a high speed copier, sometimes the photosensitive drum is not cleaned completely. Namely after a photosensitive drum cleaning process is over, if even a small quantity of residual toner remains on the photosensitive drum, the residual toner is transferred to the charging roller which contacts and rotates in association with the photosensitive drum, so that uneven electrification occurs due to contamination of the charging roller due to the residual toner and also the substantial durability of the charging roller is poor.

On the other hand, in the "roller charging apparatus" disclosed in Japanese Patent Laid Open Publication No.

58-194061, contamination of a surface of a charging roller by toner is removed by a cleaning element, the surface of the charging roller is softer and rougher than a surface of a photosensitive drum, and in addition the charging roller rotates following movement of the photosensitive drum, so that if a rubber blade is used as a cleaning element, rotation of the charging roller becomes unstable, which may disadvantageously cause uneven electrification. Also if such a material as felt or sponge is used as the cleaning element, foreign materials such as toner are stuffed in or deposited on the cleaning element, which makes it impossible to use the cleaning element. Furthermore, it is impossible to prevent generation of abnormal images like horizontal stripes when an image forming apparatus with the roller charging apparatus loaded therein is kept in a down state for a long time.

In the roller charging apparatus shown in FIG. 18, as the charging roller is directly contacted to a surface of a photosensitive element, so that foreign materials such as residual toner on a surface of a photosensitive element is transferred to a surface of a charging roller to contaminate the surface of the charging roller and a function of the charging roller becomes lower.

Furthermore, if an image forming apparatus with a roller charging apparatus loaded therein is kept in the down state for a long time, characteristics of the charging roller in an area where the charging roller contacts a surface of a photosensitive element changes, so that, when image forming is executed, abnormal images looking like horizontal stripes may disadvantageously be generated.

SUMMARY OF THE INVENTION

It is a first object of the present invention to suppress increase of cost of the apparatus itself and generation of a large quantity of ozone as well as to prevent deterioration of charging members and a photosensitive element and to suppress generation of environmental pollution.

It is a second object of the present invention to provide a roller charging apparatus which can homogeneously electrify an object when only a DC voltage is loaded.

It is a third object of the present invention to provide a roller charging apparatus having high durability.

is It a fourth object of the present invention to prevent generation of uneven electrification due to contamination of a charging roller by toner as well as to inhomogeneous rotation thereof and improve substantial durability of the charging roller.

It is a fifth object of the present invention to prevent contamination of a charging roller by toner and suppress generation of abnormal images such as horizontal stripes.

In the roller charging apparatus according to the present invention, the charging roller is built with epichlorohydrin rubber, so that it is possible to eliminate electric nonuniformity of a conductive elastic layer and to be electrified by loading only a DC voltage. In addition durability can be improved by setting the roller hardness of the charging roller to 42 (measured by a JISA hardness meter) or more.

Also in the roller charging apparatus according to the present invention, when the charging roller comprises two layers of an elastic layer made of epichlorohydrin rubber and a surface layer made of polyamide resin and covering the surface of the elastic layer, electric nonuniformity of a conductive elastic layer is eliminated, electrification can be executed by only loading a DC voltage, and the easiness in cleaning becomes higher. Also the durability can be improved by setting the roller hardness of the charging roller to 42 (measured by a JISA hardness meter) or more.

Also in the roller charging apparatus according to the present invention, when the charging roller comprises two layers of an elastic layer made of epichlorohydrin rubber and a surface layer made of fluorine resin containing carbon and covering the elastic layer, electric nonuniformity of the conductive elastic layer is eliminated, electrification can be executed by loading only a DC voltage, and the easiness in cleaning becomes higher. Also the durability can be improved by setting the roller hardness of the charging roller to 42 (measured by a JISA hardness meter) or more.

Also in the roller charging apparatus according to the present invention, when a roller diameter $D_r$ of the charging roller and a drum diameter $D_d$ of the photosensitive drum are set so that the expression of $D_d/D_r \geqq 4$ is met, homogeneous electrification is executed efficiently.

Also in the roller charging apparatus according to the present invention, when a position where the charging roller contacts the photosensitive element is near a driving roller or a slave roller for the photosensitive belt and at the same time the contact width or the nip width is 3 mm or more, homogeneous electrification is executed efficiently.

Also in the roller charging apparatus according to the present invention, when a contact pressure P1 and a friction coefficient $\mu_1$ between the charging roller and the photosensitive drum, a contact pressure $P_2$ and a friction coefficient $\mu_2$ between the charging roller and the cleaning blade are set so that relations of $P_1>P_2$ and $\mu_1<\mu_2$ are satisfied simultaneously, contamination of the charging roller by toner can be prevented and also homogeneous rotation of the electrification can be insured.

Also in the roller charging apparatus according to the present invention, when a rubber hardness of the charging roller is higher than that of the cleaning blade, if the charging roller is made of epichlorohydrin rubber having the rubber hardness of 40 (JISA) or more and the cleaning blade is made of synthetic rubber having the rubber hardness of 40 (JISA) or less, contamination of the charging roller by toner can be prevented, and also homogeneous rotation of the charging roller can be insured.

Also in the roller charging apparatus according to the present invention, when the surface of the charging roller has the same electrification polarity as that of the developing toner, toner is hardly deposited on the surface of the charging roller, or toner deposited on the surface can easily be removed, and removal of toner can efficiently be carried out with a small blade pressure.

Also in the image forming apparatus according to the present invention, when the surface of the charging roller is covered with fluorine resin and the cleaning blade is formed with ethylene propylene rubber or urethane rubber, toner having a negative polarity is hardly deposited on the surface of the charging roller, toner deposited on the surface of the charging roller can easily be removed, and removal of toner can efficiently be carried out with a small blade pressure.

Also in the image forming apparatus according to the present invention, when the surface of the charging roller is covered with polyamide resin and at the same time the cleaning blade is formed with urethane rubber or ethylene propylene rubber, toner having a positive polarity is hardly deposited on the surface of the charging roller, toner deposited on the surface of the charging roller can easily be removed, and removal of toner can efficiently be carried out with a small blade pressure.

Also in the image forming apparatus according to the present invention, cleaning of the charging apparatus can be executed by periodically rotating the photosensitive drum and the charging roller in null when image formation is not being executed.

Also in the roller charging apparatus according to the present invention, a lubricant additive film layer is formed on a surface of the charging roller, contamination of the charging roller by toner can be prevented, and also generation of abnormal images such as horizontal stripes can be suppressed.

Also in the roller charging apparatus according to the present invention, a lubricant additive applyer for applying lubricant additive onto the surface of the charging roller is provided, contamination of the charging roller by toner can be prevented, and also generation of abnormal images such as horizontal stripes can be suppressed.

Also in the roller charging apparatus according to the present invention, a lubricant additive such as stearic acid zync is applied to the surface of the charging roller, contamination of the charging roller by toner can be prevented, and also generation of abnormal images such as horizontal stripes can be suppressed.

Also in the roller charging apparatus according to the present invention, low cost and space-saving application of lubricant additive is realized by locating the lubricant additive above the charging roller and contacting the lubricant additive to the charging roller making use of tare weight of the lubricant additive.

Other objects and features of this invention will become understood from the following description with reference to the accompanying drawings.

DESCRIPTION OF THE PREFERRED EMBODIMENTS

Figure 1:
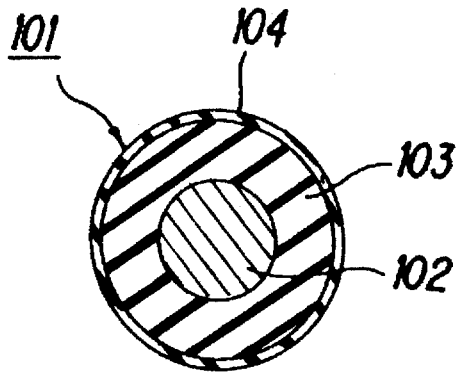
FIG. 1 is an explanatory view for configuration of the charging roller according to Embodiment 1 of the present invention.

Prior to description of Embodiments 1 to 5, at first description is made for general outline of the present invention. In the conventional technology, due to use of an AC power supply unit, there are such disadvantageous problems as cost increase of the apparatus itself, waste of a large quantity of an AC current, increase of power cost, generation of a large quantity of ozone, deterioration of charging members and a photosensitive element, and poor substantial durability. To solve these problems, a roller charging apparatus which can be electrified when only a DC voltage is loaded should be used in place of an AC power supply unit, but when only a DC voltage is loaded, uneven electrification occurs.

The present inventor investigates a cause for generation of uneven electrification when only a DC voltage is loaded, and found that the cause relates to the elastic layer which is a synthetic rubber/carbon distributed layer. This fact was turned out in an experiment carried out with a charging roller in which a conventional type of a charging roller's conductive elastic layer (made of a high resistance synthetic rubber/carbon distribution system) was replaced with medium resistance epichlorohydrin rubber not containing conductive particles such as carbon.

Namely uneven electrification by a charging roller of a conventional type of roller charging apparatus in which only a DC voltage is loaded is caused by electric nonuniformity of a conductive elastic layer due to distribution fault of carbon/synthetic rubber, and when epichlorohydrin rubber, which is not a distribution system, is used, the electric nonuniformity is eliminated, and the uneven electrification generated with only a DC voltage is loaded does not occur.

Also when only a DC voltage is loaded, the voltage resistance of a roller layer may cause a problem, but by using epichlorohydrin rubber having a medium degree of resistance in the elastic layer, the voltage resistance can remarkably be improved as compared to that in a case where the conventional type of carbon/synthetic rubber system is used in the conductive elastic layer.

Furthermore, the epichlorohydrin rubber has an appropriate degree of surface hardness as well as proper surface characteristics, so that the epichlorohydrin rubber can fully be used as a charging roller even only with an elastic layer (having a thickness in a range from 1 to 5 mm). Furthermore, the durability can substantially be improved by providing a surface layer made of non-adhesive resin (having a thickness in a range from 5 to 50 μm) and forming a two-layered charging roller comprising an elastic layer and a surface layer, to improve the surface characteristics (such as the cleaning capability when foreign materials, such as toner, deposited on a surface of a roller are removed with cleaner).

In addition, such a material as oil to lower (or soften) a roller hardness is not impregnated in the elastic layer, so that it is not necessary to provide a layer for preventing oil from oozing out, and for this reason a very simple construction can be realized.

On the other hand, the rubber hardness of an elastic element in the conventional type of charging roller is in a range from 30 to 40 (JISA), while the rubber hardness of an elastic element (epichlorohydrin rubber) in the charging roller according to the present invention is relatively higher, 40 (JISA) or more, so that it is necessary to rise an allowance of a joint surface for homogeneously charging the entire surface of a photosensitive element to the same voltage level. The present inventor found out that this problem can be solved by expanding a joint surface between the charging roller and the photosensitive element by means of changing a form of the photosensitive element to be electrified.

Detailed description is made hereinafter to embodiments of the charging apparatus according to the present invention and an image forming apparatus using the same with reference to the related drawings.

FIG. 1 shows a configuration of a charging roller 101 of a roller charging apparatus according to Embodiment 1 of the present invention, which is formed by molding an epichlorohydrin rubber elastic layer 103 (having a thickness of 3 mm) around a core metal 102 having a diameter of 8ϕ so that the outer diameter of the roller is 14ϕ. Electric resistance of this elastic layer 103 is $3\times10^8\Omega$-cm. Then, a thin (around 5 μm) surface layer (coat) 104 made of polyamide resin is provided on this elastic layer 103. The roller hardness of this charging roller 101 is 50 (measured by a JISA hardness meter).

Next description is made for roller hardness of this charging roller. The roller hardness of a charging roller is defined as hardness measured by a JISA hardness meter (hardness meter of JISK 6301 A type) in the state where a material for the roller has been formed into a shape of roller to differentiate it from rubber hardness (JISA) measured in the state where the material has not been formed into a shape of roller. This roller hardness can be used to generally evaluate firstly elasticity of the roller layer, secondly a contact degree (nip width) between a roller and a photosensitive element, and thirdly a state of a roller's surface, so that this index can be used as a parameter to evaluate characteristics of a charging roller in practical use.

Next detailed description is made for a method of measuring the roller hardness with reference to FIG. 17. FIG. 17A and FIG. 17B are an explanatory view for illustrating configuration of a JISA hardness meter based on a spring system (made by Teclock), and in this figure, the reference numeral 500 indicates a JISA hardness meter, and this JISA hardness meter comprises a mounting base 500*a* on which a weight 501 is placed to load pressure in the direction for the charging roller 101, a scale section 500*b* to indicate hardness and a result of measurement, a pressurized surface section 500*c* to which a surface of the charging roller 101 is contacted, and a needle 500*d* which is always energized in the downward direction by a spring, thrusts out from a central hole of said pressurized surface 500*c*, modes according to roller hardness of the charging roller 101, and delivers the range of movement to the scale section 500*b*.

Figure 17A:
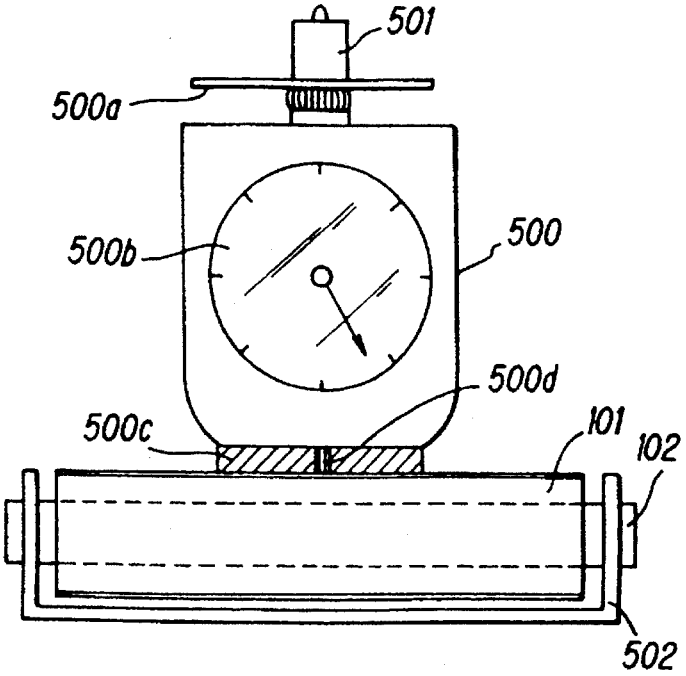
FIG. 17A is an explanatory view illustrating detailed configuration of JISA hardness meter for measuring roller hardness of charging roller.
Figure 17B:
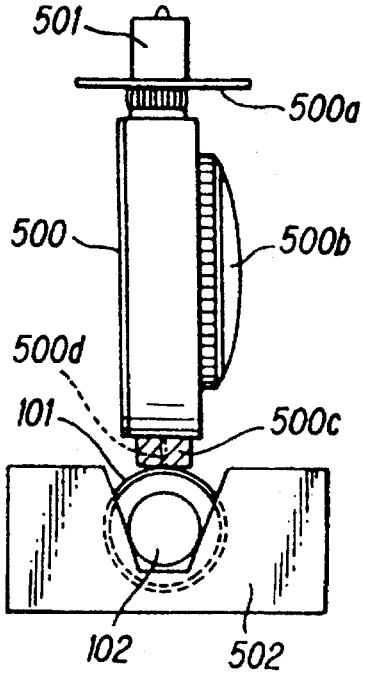
FIG. 17B is an explanatory view illustrating detailed configuration of JISA hardness meter for measuring roller hardness of charging roller.
Figure 17C:
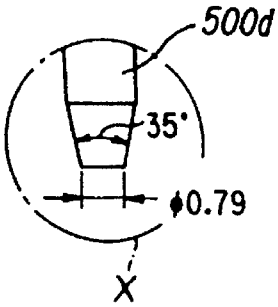
FIG. 17C is an explanatory view illustrating configuration of a tip section of a needle.
Figure 17D:
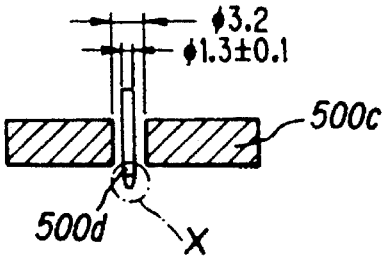
FIG. 17D is an enlarged view illustrating a portion of the pressurized surface section and a portion of the needle.
Figure 18:
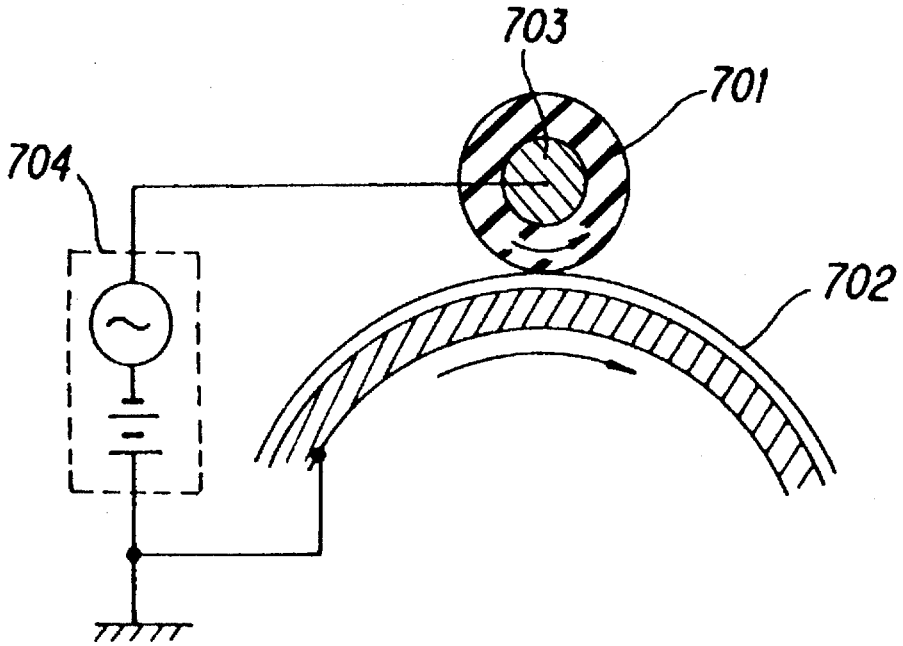
FIG. 18 PRIOR ART
FIG. 18 is an explanatory view illustrating a method of using the conventional type of charging roller.

FIG. 17C shows an enlarged configuration of a tip section of the needle 500*d*, while FIG. 17D is an enlarged view of a portion of the pressurized surface section 500*c* and a portion of the needle 500*d*. The reference numeral 502 is a supporting base to fix the charging roller 101 by supporting a core metal 102 of the charging roller 101.

When measuring roller hardness of the charging roller 101 with this JISA hardness meter, the core metal 102 of the charging roller 101 is fixed on the supporting base 502, and the pressurized surface section 500*c* of the JISA hardness meter with a 1 Kg weight 501 mounted on the mounting base 500*a* is contacted to a surface of the charging roller 101. As a result, the needle 500*d* being pressurized by a spring and thrusting out from a hole of the pressurized surface section 500*c* is pushed back. A distance of movement of the needle 500*d* pushed back as described above is shown as roller hardness on the scale section 500*b*.

Herein, when the scale section 500*b* shows a value of 0, it indicates that the needle 500*d* thrusts out by 2.54 mm from the pressurized surface 500*c*, and if the scale section 500*b* show a value of 100, it indicates that the needle 500*d* is coplanar to the pressurized surface 500*c*. In this measurement, the pressurized surface 500*c* is contacted so that the needle 500*d* will be vertical to the charging roller 101 fixed on the supporting base 502 by the core metal 102, a value shown on the scale section 500*d* is read in 30 sec after the pressurized surface is contacted to the charging roller 101, and roller hardness of the charging roller is obtained from the value. Also in the following embodiments, roller hardness of the charging roller 101 is measured in the same way.

Figure 2:
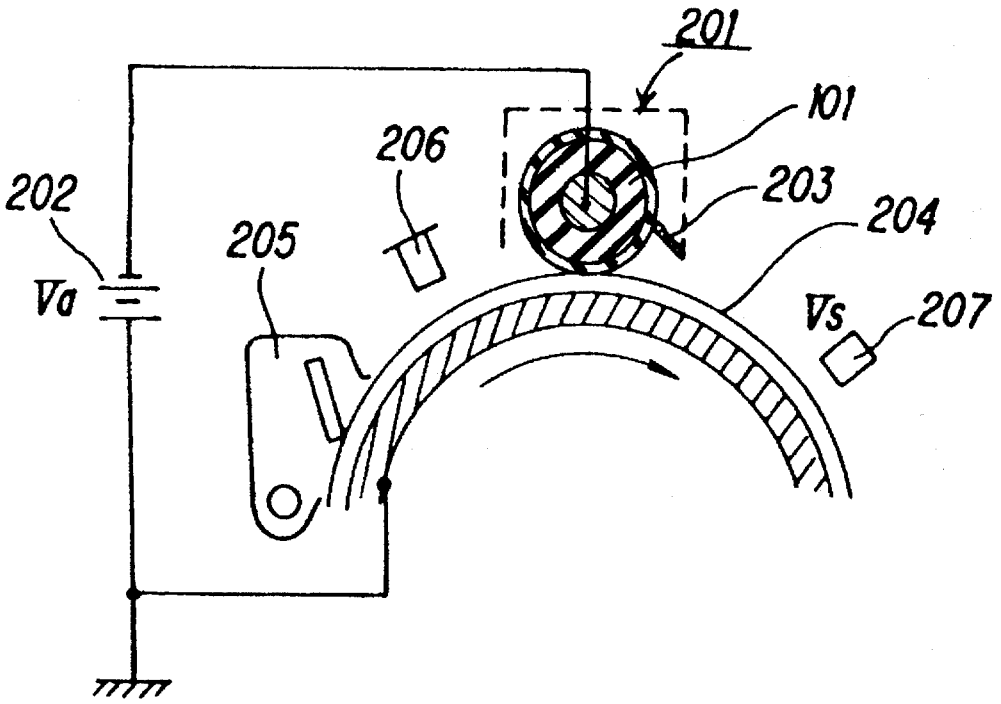
FIG. 2 is an explanatory view for configuration of an image forming apparatus incorporating the roller charging apparatus according to Embodiment 1.

FIG. 2 shows a portion of configuration of an image forming apparatus (digital copier) incorporating the roller charging apparatus according to Embodiment 1 of the present invention, and in this figure, designated at the reference number 201 is a roller charging apparatus according to the present invention comprising a charging roller 101, a DC power supply unit (Va) 202 to load a voltage to the charging roller 101, and a cleaning blade 203 (urethane rubber having a thickness of 0.5 mm) for removing toner deposited on the charging roller 101.

Also in this figure, designated at the reference number 204 is a photosensitive drum which is an OPC with a photosensitive layer thickness of 30 μm, at 205 a drum cleaner for removing toner remaining on the photosensitive drum 204 after transfer processing is over, at 206 an electric charge removing lamp for removing a residual charge on the photosensitive drum 204, and at 207 an electrometer for measuring a voltage Vs on the surface of the photosensitive drum 204.

Assuming the configuration as described above, now operation thereof is described below. The initial electrification characteristics of this charging roller 101 was measured, Vs was −800 V and a dispersion width of static voltage Vs under the voltage Va of −1.5 KV, which suggests that the homogeneity in electrification is excellent.

Then durability of the roller charging apparatus 201 was tested as described below. The charging roller 101 was contacted onto the photosensitive drum 204 with the pressure of 30 gf/cm, and 22K sheets of images were formed for three months. The electrification characteristics at this point of time was Vs of −700 V and a static voltage Vs dispersion width was 35 V with the image quality not so different from that in the initial stage, so it was shown that the durability was excellent.

Namely the roller charging apparatus according to Embodiment 1 has more excellent voltage resistance as compared to that of the conventional type of roller charging apparatus, and also the surface hardness of the roller is higher and distortion and deformation due to elasticity thereof smaller, so that the durability is remarkably higher than the conventional ones.

Figure 3:
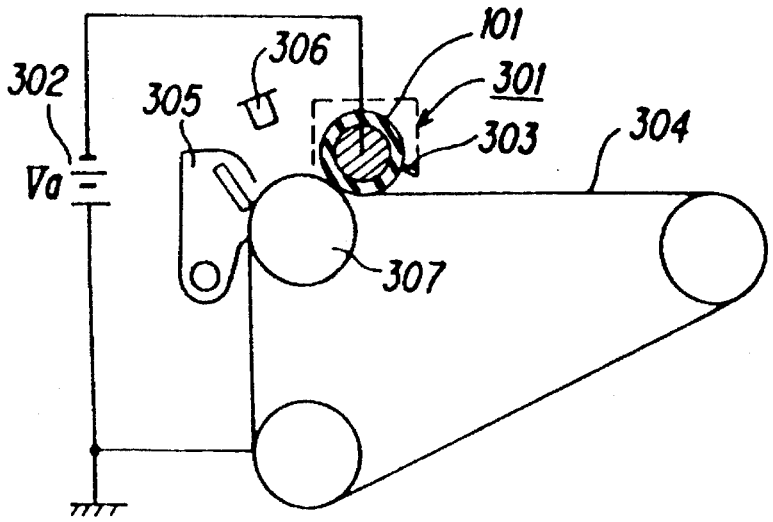
FIG. 3 is an explanatory view for configuration of an image forming apparatus incorporating the roller charging apparatus according to Embodiment 2 of the present invention.

FIG. 3 shows a portion of a configuration of an image forming apparatus (laser printer) incorporating a roller charging apparatus according to Embodiment 3, and in this figure the reference numeral 301 indicates a roller charging apparatus comprising the charging roller 101 shown in FIG. 1, the DC power supply unit (Va) 302 for loading a voltage to the charging roller 101, and the cleaning blade 303 (urethane rubber having a thickness of 0.5 mm) for removing toner deposited on the charging roller 101.

Also in this figure, designated at the reference numeral 304 is a photosensitive belt, at 305 a drum cleaner which removes toner remaining on the photosensitive belt 304 after the transfer processing, at 306 an electric charge removing lamp for eliminating a residual charge on the photosensitive belt 304, and at 307 a driving roller for driving the photosensitive belt 304.

With the system configuration as described above, the initial electrification characteristics of the charging roller 101 was measured as in the case of Embodiment 1, and Vs was −800 V and the dispersion width of static voltage Vs was 10 V when Va was −1.5 KV, which indicates that the homogeneity of electrification is excellent.

Then, the durability of the roller charging apparatus 301 was tested as described below. The charging roller 101 was contacted onto the photosensitive belt 304 with the pressure of 30 gf/cm, and 22K sheets of images were formed for three months. The electrification characteristics at this point of time was Vs of −700 V and a static voltage Vs dispersion width was 35 V with the image quality not so different from that in the initial stage, so it was shown that the durability was excellent.

Namely the roller charging apparatus according to Embodiment 1 has more excellent voltage resistance as compared to that of the conventional type of roller charging apparatus, and also the surface hardness of the roller is higher and distortion and deformation due to elasticity thereof smaller, so that the durability is remarkably higher than the conventional ones.

In Embodiment 3, in place of the charging roller 101 in Embodiment 1, an epichlorhydrin rubber elastic layer (having a thickness of 3.5 mm) was formed around a core metal with a diameter of 8ϕ so that the outer diameter of the roller would be 15ϕ, and a charging roller (not shown) with a surface layer (coat) with a thickness of 30 μm made of fluorine resin containing carbon by 4% as a solid component provided on this elastic layer was incorporated in the image forming apparatus shown in FIG. 2. Configuration of other portions is the same as that of Embodiment 1, so that illustration and description thereof are omitted herein.

With the description described above, operation thereof is described below. At first the initial electrification characteristics of this charging roller was measured using the electrometer 207, and Vs was −780 V and the dispersion width of the static voltage Vs was 20 V when Va was −1.5 KV, which indicates that the homogeneity in electrification was excellent. Load of the charging roller was 33 gf/cm and roller hardness was 53 (measured by a JISA hardness meter).

Then the electrification characteristics after 28K sheets of images were formed for three months was checked using the image forming apparatus described above, and Vs was −760 V with the static voltage Vs dispersion width of 30 V and the image quality was not substantially different from that in the initial stage, which indicated that the durability was excellent.

Furthermore, a result of test in Embodiment 3 was compared to that in Embodiment 1, and the result in Embodiment 3 was equivalent to or better than that in Embodiment 1. Namely voltage resistance of an epichlorohydrin rubber elastic layer was excellent, the surface hardness of the roller was high, distortion and deformation due to elasticity thereof were small, and the capability of the surface layer made of fluorine resin to clean foreign materials such as toner deposited on the surface of the charging roller was excellent, which indicates that the durability thereof as a roller charging apparatus has been improved.

A roller diameter $D_r$ of the charging roller according to Embodiment 3 was 15 mm, while a drum diameter $D_d$ of the photosensitive drum 204 in the image forming apparatus shown in FIG. 2 was 80 mm, and in this case the homogeneity in electrification was excellent, and the charging roller was electrified to almost the same static voltage in the longitudinal direction (at the center and the edges thereof).

Figure 4:
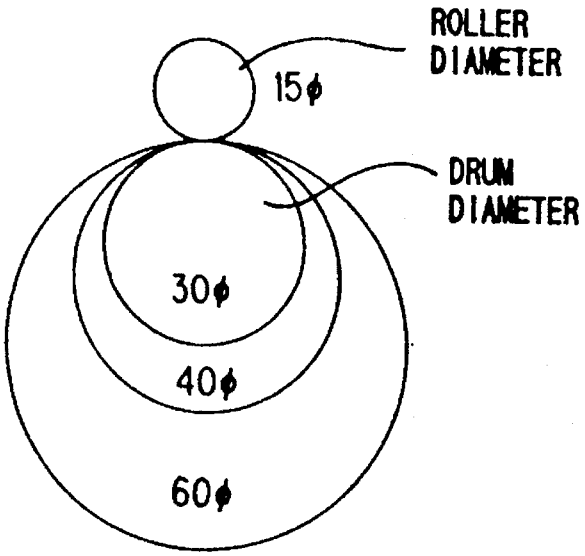
FIG. 4 shows a roller diameter of a charging roller and a drum diameter of a photosensitive drum each used in Embodiment 4 of the present invention.

In Embodiment 4, durability of the roller charging apparatus was tested changing a ratio of a roller diameter of the charging roller vs a drum diameter of the photosensitive drum. Concretely the charging roller according to Embodiment 3 (Elastic layer: epichlorohydrin rubber, surface layer: fluorineresin containing carbon, roller diameter $D_r$=15 mm, roller hardness=53 (measured by a JISA hardness meter)) was incorporated in three types of printers (or copiers) with drum diameters $D_d$ of the photosensitive drum as shown in FIG. 4 of 30ϕ, 40ϕ and 60ϕ respectively, and the homogeneity in electrification was tested.

Figure 5:
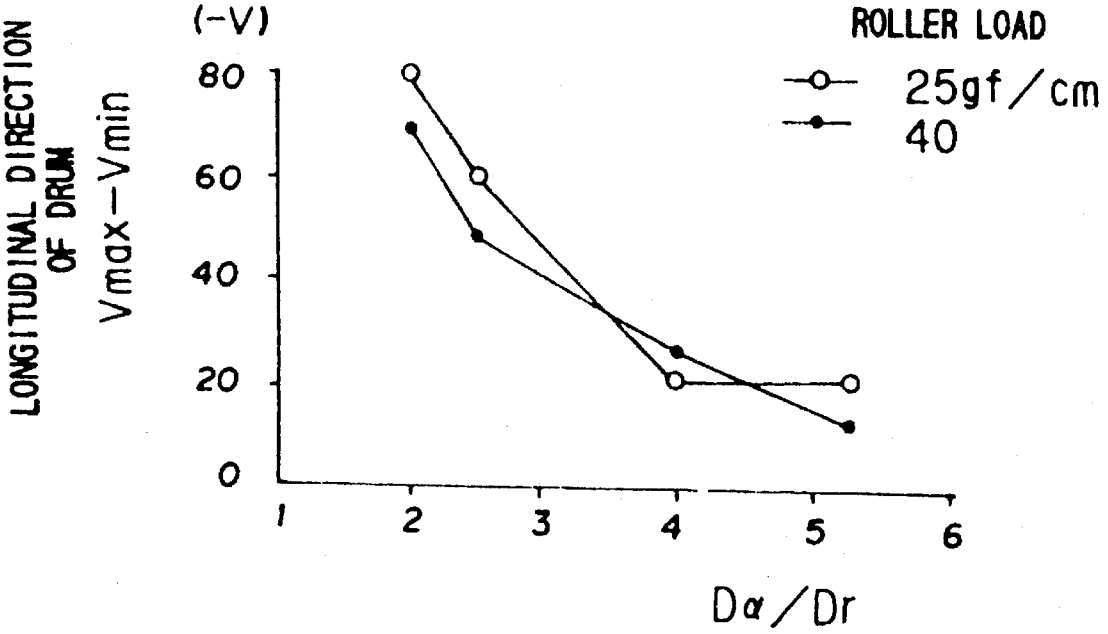
FIG. 5 is a graph showing a relation between a voltage difference in the longitudinal direction of the drum and a ratio of the roller diameter $D_r$ of the charging roller vs the drum diameter $D_d$ of the photosensitive drum $D_d$ ($D_d/D_r$)

As a result, the homogeneity in electrification in the rotational direction of the drum was identical in the 3 types of printers having drum diameters $D_d$ of 30ϕ, 40ϕ, and 60ϕ respectively, and the homogeneity was excellent in all the cases, but a difference in static voltage in the longitudinal direction of the drum was larger with the electrification more inhomogeneous as the drum diameter was smaller. FIG. 5 is a graph showing a relation between a difference of static voltage in the longitudinal direction of a drum and a ratio of a roller diameter of a charging roller vs a drum diameter $D_d$ of a photosensitive drum ($D_d/D_r$).

When the roller load was made larger (up to 40 gf/cm), horizontal black stripes appeared in the image when the drum diameter was 30ϕ or 40ϕ. It can be considered that this phenomenon occurs because a homogeneous and full nip width can not be obtained in the longitudinal direction of a roller (drum) with a charging roller having a high surface hardness of the roller. For this reason, in a case of a charging roller having the roller hardness of 42 (measured by a JISA hardness meter) or more, it is desirable that a roller diameter $D_r$ of the charging roller and a drum diameter of the photosensitive drum $D_d$ satisfy the relation of $D_d/D_r \geqq 4$. In other words, by incorporating a roller charging apparatus in an image forming apparatus on the condition that the relation of $D_d > D_r \geqq 4$ is satisfied, it is possible to maintain homogeneous electrification.

In Embodiment 5 of the present invention, by setting a position where the charging roller contacts a photosensitive belt to near a driving roller or a subordinate roller of the photosensitive belt and at the same time also setting a contact width or a nip width to 3 mm or more, homogeneous electrification can be carried out efficiently.

At first, as the charging roller 101 for the roller charging apparatus according to Embodiment 5 of the present invention, an epichlorohydrin rubber elastic layer (having a thickness of 2 mm) was formed around a hollow core metal having a diameter of 12ϕ so that the outer diameter would be 16ϕ, and a charging roller (not shown) with a surface layer (coat) having a thickness of 40 μm and made of fluorine resin containing carbon by 4% provided on the elastic layer was prepared. The roller hardness was 56 (measured by a JISA hardness meter).

Figure 6:
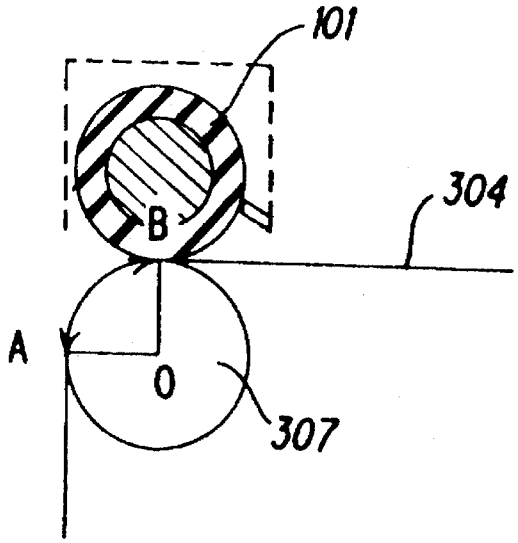
FIG. 6 is an explanatory view showing a position of an roller charging apparatus (charging roller) according to Embodiment 5 of the present invention.

This charging roller 101 (roller charging apparatus) was incorporated in the image forming apparatus (laser printer) shown in FIG. 3. If the position where the charging roller 101 contacts the photosensitive belt 304 is identical to the position where a rear surface of the photosensitive belt 304 contacts the driving roller 307 (the range indicated by AB in FIG. 6), an adequate nip width can not be obtained line in case of the small diameter drum shown in FIG. 4, and the difference in static voltage in the longitudinal direction of the roller (between the central portion and the edge portions) was large. So the charging roller 101 was contacted to the photosensitive belt 304 with an appropriate load so that the nip width would be 3 mm or more outside the range indicated by AB in FIG. 6 on the photosensitive belt 304, and the entire surface of the photosensitive belt was almost homogeneously electrified to the same static voltage. In other words, by setting a position of the charging roller 101 so that the nip width will be 3 mm or more, homogeneous electrification can be carried out efficiently.

Prior to a description of Embodiments 6 to 8, now description is made for other points of the general configuration of the present invention. As a method of removing foreign materials such as toner deposited on a surface of a charging roller, there is a method of cleaning by contacting a cleaning member to a charging roller. As the cleaning member for instance, felt, sponge, and a rubber blade are available. However, if felt or sponge is used as the cleaning member, foreign materials such as toner are disadvantageously stuffed in and adhered as it is to the cleaning member.

On the other hand, when a thin and soft rubber blade is used, toner deposited on a surface of a charging roller can be dropped downward (onto a photosensitive drum) by homogeneously and slightly contacting the rubber blade to the surface of the charging roller, but a surface of a charging roller is softer and rougher than that of a photosensitive drum, and in addition the charging roller rotates following rotation of the photosensitive drum, so that in a blade cleaning method such as that generally used for cleaning a photosensitive drum or the similar components, rotation of the charging roller becomes unstable.

For this reason, the present inventors tested the following methods ① to ② to prevent contamination of a charging roller by toner and generation of uneven electrification due to inhomogeneous rotation as well as to improve the substantial durability of the charging roller, and obtained good results in blade cleaning for charging rollers.

① A rubber blade having a higher rubber hardness that of a charging roller is used as a meaning member.

② As a friction coefficient between a charging roller and a rubber blade is larger than that between a charging roller and a photosensitive drum, so that a contact pressure between the charging roller and the rubber plate should be set to a value far smaller than that between the charging roller and the photosensitive drum.

③ A surface material of the charging roller and that of the blade are selected so that a polarity of static voltage on the surface of the charging roller generated due to friction between the charging roller and the cleaning blade will be the same as that of toner.

④ To clean the charging roller, the photosensitive drum and the charging roller are rotated in null periodically when an image is not being formed.

Next description is made for the roller charging apparatus using any of methods ① to ② and the image forming apparatus using the same with reference to Embodiments 6 to 8 of the present invention.

In Embodiment 6, a contact pressure $P_1$ and a friction coefficient $\mu_1$ between a charging roller and a photosensitive drum, and a contract pressure $P_2$ and a friction coefficient $\mu_2$ between a charging roller and a cleaning blade are set to satisfy relations of $P_1 > P_2$ and $\mu_1 < \mu_2$ so that contamination of a charging roller by toner can be cleaned and homogeneous rotation of the charging roller is insured. Also by setting a rubber hardness of the charging roller to a higher level than that of a cleaning blade, when the charging roller is made of epichlorohydrin rubber having a rubber hardness of 40 (JISA) or more and the cleaning blade is made of synthetic rubber having a rubber hardness of 40 (JISA) or more, contamination of the charging roller by toner can be cleaned and homogeneous rotation of the charging roller is insured.

Figure 7:
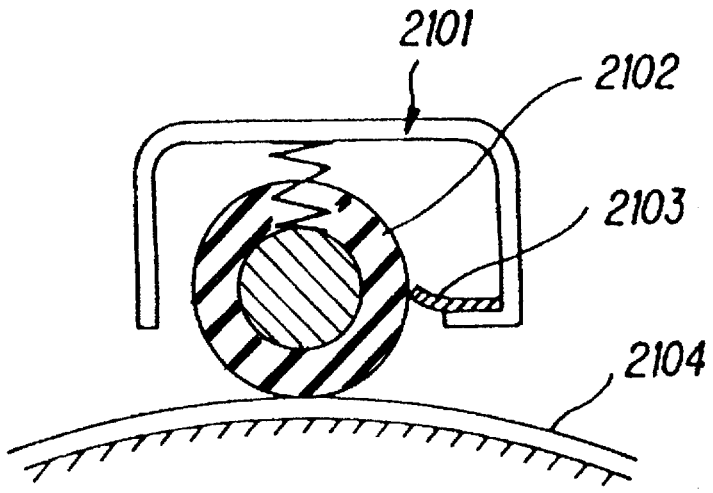
FIG. 7 is an explanatory view showing configuration of a roller charging apparatus according to Embodiment 6 of the present invention.

FIG. 7 shows a configuration of a roller charging device 2101 according to Embodiment 1, and in this figure the reference numeral 2102 indicates a charging roller, while the reference numeral 2103 indicates a cleaning blade. Also in this figure, the reference numeral 2104 indicates a photosensitive drum. Herein, is formed by molding an epichlorohydrin rubber elastic layer (having a thickness of 3 mm) around a core metal having a diameter of 8ϕ so that the outer diameter of the roller is 14ϕ. Electric resistance of this elastic layer is $3\times10^8\Omega\cdot$cm, and the rubber hardness is 40 (JISA). Then, a thin polyamide resin film (having a thickness of around 5 μm) is provided on this elastic layer. The roller hardness is 41 (measured by a JISA hardness meter).

On the other hand, a cleaning blade 2103 is an ethylene propylene rubber blade (having a thickness of 1.5 mm) with the rubber hardness adjusted to 35 (JISA) by using plasticizer. And rubber hardness of the cleaning blade may be set to a higher value than that of the charging roller.

Also a photosensitive drum 2104 is an OPC photosensitive element, which is a CTL (surface layer) having a thickness of about 28 μm formed by making a CGL (elastic layer) having a thickness of about 0.3 μm on an A1 drum having a diameter of 80ϕ, then applying one weight portion of hydrazon (CTM) as well as one weight portion of polycarbonate as CTL distributed in tetrahydrofuran on the CGL by means of dipping method.

Figure 8:
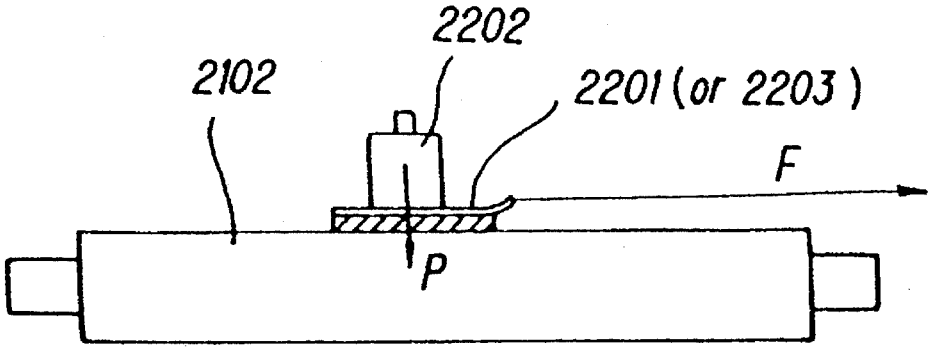
FIG. 8 is an explanatory view illustrating a method of measuring a friction coefficient between the charging roller and the photosensitive drum shown in FIG. 7 as well as a friction coefficient between the charging roller and the cleaning blade also shown in the same figure.

FIG. 8 is an explanatory drawing showing a method of measuring a friction coefficient between the charging roller 2102 and the photosensitive drum 2104 each shown in FIG. 7 and a friction coefficient between the charging roller 2102 and the cleaning blade 2203. At first, a friction coefficient $\mu_1$ when a sheet material 2201 with a CTL material of the photosensitive drum 2104 applied like a milar film onto a surface of the charging roller 2102 is pressed to the charging roller 2102 with a weight 2202 for applying a pressure P and then pulled with a tensile force F was measured, and $\mu_1$ was 0.5. Then a friction coefficient $\mu_2$ when a sheet material 2203 with the cleaning blade 2103 adhered thereto in place of the CTL material was pressed with the weight 2202 for applying a pressure P and pulled with a tensile force F was measured, and $\mu_2$ was 1.5. The above results indicate that the friction coefficients satisfy the relational expression of $\mu_1$ (0.5)<$\mu_2$ (1.5).

Then in the roller charging apparatus 2101 shown in FIG. 7 where the friction coefficients satisfy the relational expression of $\mu_1<\mu_2$, a load of 550 g was added to both edges of the charging roller 2102 (length of the roller: 320 mm) respectively so that the contact pressure $P_1$ between the charging roller 2102 and the photosensitive drum 2104 was 34 g/cm, and contamination of a surface of the charging roller 2102 was observed changing a contact pressure $P_2$ between the charging roller 2102 and the cleaning blade 2103 to find that the cleaning capability is excellent when the contact pressure $P_2$ was in a range from 2 to 5 g/cm and contamination by toner could fully be removed. Especially in this case (where $\mu_1$ was 0.5, $\mu_2$ was 1.5, and the contact pressure $P_1$ was 34 g/cm), contamination by toner can be removed most efficiently when the contact pressure $P_2$ is 3 g/cm.

Figure 9:
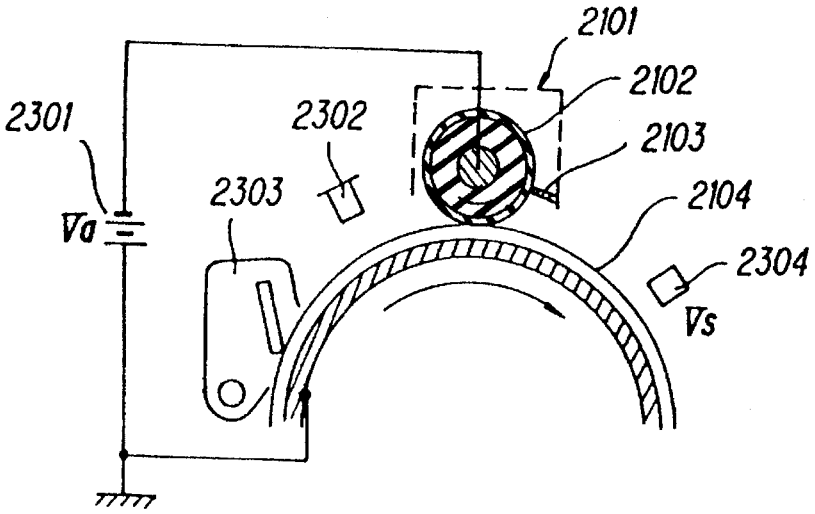
FIG. 9 is an explanatory view illustrating a portion of a copier incorporating the roller charging apparatus shown in FIG. 7.

FIG. 9 shows a portion of a copier incorporating the roller charging apparatus 2102 shown in FIG. 7. In this figure, designated at the reference numeral 2301 is a DC power supply unit (Va) for loading a voltage to the charging roller 2102 and the photosensitive drum 2104, at 2302 an electric charge removing lamp for removing a residual charge on the photosensitive drum 2104, at 2303 a drum cleaner for removing residual toner on the photosensitive drum 2104 after a transfer processing, and at 2304 an electrometer for measuring a static voltage Vs on a surface of the photosensitive drum 2104.

With the configuration as described above, now description is made for evaluation of a durability of this roller charging apparatus 2101. At first, the initial electrification characteristics of the charging roller 2102 were measured by using the electrometer 2304, and the static voltage Vs was −800 V and the dispersion width of static voltage Vs was 10 V when the loaded voltage Va was −1.5 KV, which indicates that the homogeneity of electrification is excellent.

Then after 10K sheets of images were formed, the electrification characteristics of the charging roller 2102 were measured using the electrometer 2304, and the static voltage Vs was in a range from −750 to −780 V, while the dispersion width of the static voltage Vs was 30 V. A static voltage in a contaminated portion of the photosensitive drum 2104 dropped in proportion to a degree of contamination of the surface of the charging roller 2102, but the image quality was not so different from that in the initial stage, and any specific problem did not occur in forming an image.

Furthermore, after an additional 30K sheets of images were formed, the electrification characteristics of the charging roller 2102 were measured using the electrometer 2304. The static voltage Vs was in a range from −740 to −760 V, while the dispersion width of the static voltage Vs was 20 V with fairly homogeneous contamination of a surface of the charging roller 2102, which indicates that the durability of the roller charging apparatus 2102 according to the present invention is excellent.

This good result (improvement of the durability) was obtained because the substantial durability was improved not by completely removing toner deposited on the surface of the charging roller 2102, but on the contrary by homogeneously contaminating the surface of the charging roller 2102 by means of slightly and homogeneously contacting the cleaning blade 2103 having a rubber hardness lower than that of the charging roller 2102 to the surface of the charging roller 2102.

Also when image formation is not being performed, by rotating the photosensitive drum 2104 and the charging roller 2102 in null, the photosensitive drum 2104 and the charging roller 2102 are cleaned, foreign materials deposited on the cleaning blade 2103 of the charging roller 2102 are dropped on the photosensitive drum 2104, and recovered into a development block (not shown). At the same time the surface of the charging roller 2102 is electrified due to friction with the cleaning blade 2103. Then if the same electrification polarity as that of toner is given to the surface of the charging roller 2102 due to friction between the charging roller 2102 and the cleaning blade 2103, toner is hardly deposited on the surface of the charging roller 2102, or toner deposited on the surface of the charging roller 2102 can easily be removed, and toner can efficiently be removed with a small blade pressure.

Herein, in a case where the cleaning blade 2103 is made of, for instance, polyurethane rubber or ethylene rubber, if a surface layer of the charging roller 2102 is made of polyamide resin, the surface of the charging roller 2102 is electrified to + (plus), while the cleaning blade 2103 is electrified to − (minus). And if the surface layer of the roller 2102 is made of fluorine resin, the surface of the charging roller 2102 is electrified to − (minus), while the cleaning blade 2103 is electrified to + (plus).

On the other hand, toner deposited on the photosensitive drum 2104 which could not be removed by the drum cleaner 2303 may have lost the normal electrification polarity or have been electrified to a reverse polarity. In this case, toner may easily be deposited on the surface of the charging roller 2102. Also if the surface of the charging roller 2102 is subjected to toner filming, a static voltage of the surface of the charging roller 2102 due to friction changes, and sometimes the above effect can not be expected. However, in recent years, even in a transfer process, the conventional type of corona transfer/corona separation has been shifting to belt (roller) transfer, and in the case of belt (roller) transfer, residual toner on the photosensitive drum tends to maintain the normal electrification polarity, so that toner is hardly deposited on the surface of the charging roller 2102 described above, or toner deposited on the surface of the charging roller 2102 can easily be removed, and toner can advantageously be removed with a small blade pressure efficiently.

Figure 10:
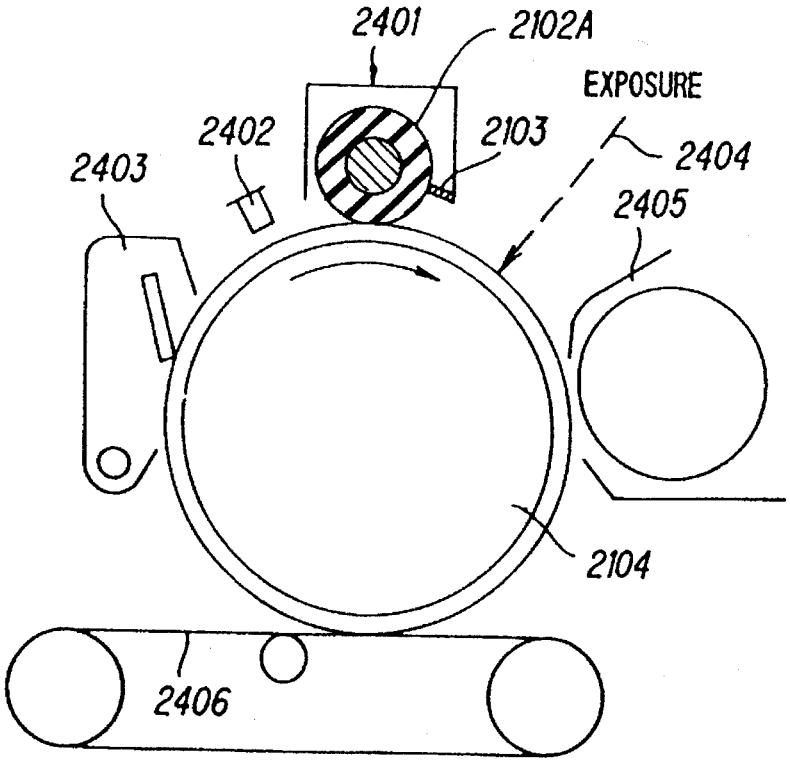
FIG. 10 is an explanatory view illustrating configuration of a roller charging apparatus and an image forming apparatus each according to Embodiment 7 of the present invention.

FIG. 10 shows a configuration of the roller charging apparatus 2401 according to Embodiment 7 of the present invention as well as of the image forming apparatus (digital copier) using the same, and a charging roller 2102A is formed by forming an epichlorohydrin rubber elastic layer having a thickness of 4 mm around a core metal having a diameter of 8ϕ and providing a surface layer made of fluorine resin (containing carbon by 4 weight %) having a thickness of 15 μm.

Also in this figure, designated at the reference numeral 2402 is an electric charge removing lamp for removing a residual charge on the photosensitive drum 2104, at 2403 a drum cleaner for removing residual toner on the photosensitive drum 2104 after a transfer processing, at 2404 a laser beam used for exposure, at 2405 a developing unit for developing a latent image on the photosensitive drum 2104 with toner, and at 2406 a transfer belt. It should be noted that the cleaning blade 2103 and the photosensitive drum 2104 are common to Embodiment 6 and the description thereof is omitted herein.

With the configuration as described above, now the operation is described below. The photosensitive drum 2104 cleaned by a drum cleaner 2403 and an electric charge removing lamp 2402 is electrified by the charging roller 2102A to −800 V, the image is exposed to the laser beam 2404, the latent image is inverted and developed with negative polarity toner to visualize it, and then the image is transferred to a recording paper by the transfer belt 2406. Then, still residual toner remains on the photosensitive drum 2104, and most of the residual toner is removed by the drum cleaner 2403.

Toner not completely removed by the drum cleaner 2403 is deposited on the charging roller 2102A, but the surface of the charging roller 2102A has been electrified to − (minus) due to friction with the cleaning blade 2103, so that toner having a negative polarity is hardly deposited thereon. Durability of the roller charging apparatus 2401 in this digital copier is excellent, and even after 30K sheets of images are formed, the surface of the charging roller 2102A is contaminated little, and the static voltage dropped by only 10 to 30 V.

As an example for comparison, the same experiment was carried out using a charging roller with a surface layer using polyamide resin having a thickness of 10 μm in place of the charging roller 2102A shown in FIG. 10 (polarity of static voltage due to friction on the surface of the charging roller is plus), and it was observed that a degree of contamination on the surface of the charging roller was far higher than that on the charging roller 2101A according to Embodiment 7 and the static voltage largely dropped. From this example for comparison, the effect of forming a surface layer of a charging roller with fluorine resin (containing carbon by 4 weight %) is clear.

Then as Embodiment 8 of the present invention, using an image forming apparatus using a charging roller formed by forming an epichlorohydrin rubber elastic layer having a thickness of 4 mm around a core metal having a diameter of 8ϕ and providing thereon a surface layer made of polyamide resin having a thickness of 10 μm and a cleaning blade made of ethylene propylene rubber (or urethane rubber) with the remaining portion of the configuration identical to that in Embodiment 7, a latent image formed by exposing a photosensitive drum electrified to −800 V to a laser beam was developed with toner with a positive polarity, and a durability of the roller charging apparatus was checked after 30K sheets of images were formed like in Embodiment 7, and the result was excellent as in Embodiment 7.

Now prior to the description of Embodiments 9 to 13, description is made for a general configuration of an image forming apparatus using therein a roller charging apparatus, configuration of the charging roller to be used for the purpose, and a method of applying a lubricant additive.

Figure 11:
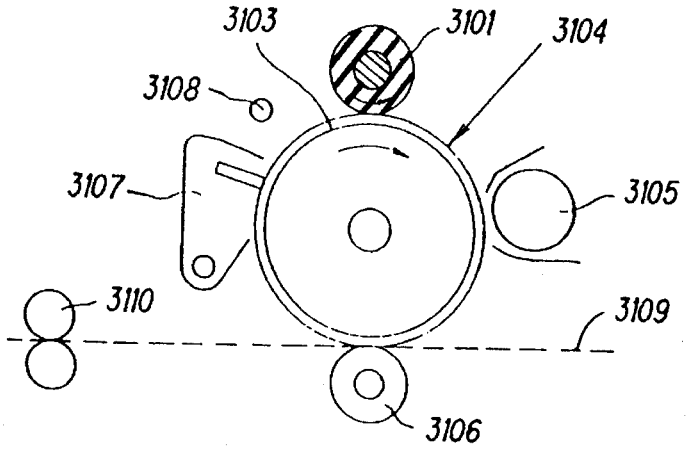
FIG. 11 is an explanatory view illustrating an example of an image forming apparatus incorporating a roller charging apparatus according to Embodiment 9 of the present invention.

FIG. 11 shows an example of an image forming apparatus using therein a roller charging apparatus, and in this figure designated at the reference numeral 3101 is a charging roller, at 3103 a photosensitive drum, at 3104 a laser beam as exposure data for forming an electrostatic latent image on the photosensitive drum 3103, at 3105 a developing unit for developing the electrostatic latent image on the photosensitive drum 3103 with toner, at 3106 a transfer roller for transferring a toner image onto recording paper 3109, at 3107 a drum cleaner for removing toner remaining on the surface of the photosensitive drum 3103 after the transfer process, at 3108 an electric charge removing lamp, at 3109 recording paper, and at 3110 a fixing unit.

Figures 12A, 12B, 12C:
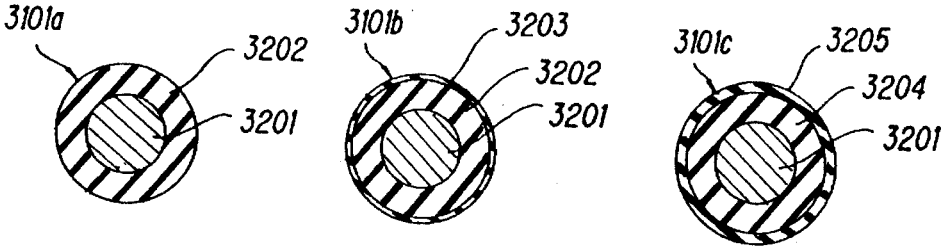
FIG. 12A is an explanatory view illustrating configuration of a charging roller available in the roller charging apparatus according to the present invention.
FIG. 12B is an explanatory view illustrating configuration of a charging roller available in the roller charging apparatus according to the present invention.
FIG. 12C is an explanatory view illustrating configuration of a charging roller available in the roller charging apparatus according to the present invention.

FIGS. 12A to 12C show examples of configurations of the charging roller 3101 according to the present invention respectively, and as the charging roller 3101*a*, there are a charging roller 3101 formed by molding a medium resistance elastic layer 3202 around a core metal 3201 as shown in FIG. 12A, a charging roller 3101*b* formed by molding the medium resistance elastic layer 3202 around the core metal 3201 and providing a surface layer 3203 on this elastic layer 3202 as shown in FIG. 12B, and a charging roller 3101*c* formed by molding a conductive elastic layer 3204 around the core metal 3201 and then providing a surface resistance layer 3205 on this elastic layer 3204 as shown in FIG. 12C.

On the other hand, as described in Embodiments 9 to 13 in detail below, the present inventor found out that prevention of contamination of a charging roller by toner and generation of abnormal images such as horizontal stripes can effectively be carried out by forming a film layer made of a lubricant additive on a surface of the charging roller 3101. The following three methods are available for applying this lubricant additive to the charging roller 3101:

① A method in which a stearic acid zinc (lubricant additive) film is formed on the surface of the charging roller 3101 before using a roller charging apparatus, and after being used for a long time the charging roller is taken out from the image forming apparatus, the surface is cleaned, and then stearic acid zinc is applied.

② A method in which solid state stearic acid zinc is pressed to the surface of the charging roller 3101 being used and is homogeneously applied to the surface when the charging roller 3101 is rotated.

③ A method in which solid state stearic acid zinc is used also as a cleaning blade (not shown) for a charging roller or is located behind a cleaning blade (at a backward position in the rotational direction of the charging roller) on the condition that the solid state stearic acid zinc is always pressed to the charging roller 3101, and the most suited method should be selected according to a type of the image forming apparatus.

Embodiment 9 is an example in which a lubricant additive film layer is previously formed on the surface of the charging roller 3101, namely an example of a method of applying lubricant additive to the charging roller 3101, in which a stearic acid zinc (lubricant additive) film is formed on the surface of the charging roller 3101 before use of the roller charging apparatus is started, or in which the charging roller 3101 which is used for a long time is taken out from the image forming apparatus, the surface is cleaned, and stearic acid zinc is applied on the surface thereof.

In the image forming apparatus shown in FIG. 11, the photosensitive drum 3103 is an OPC photosensitive element having a diameter of 80ϕ, and the charging roller 3101 is the charging roller 3101*a* shown in FIG. 12A, concretely a medium resistance rubber roller comprising an epichlorohydrin rubber elastic layer having a thickness of 3 mm and molded around a core metal having a bore of 8ϕ. A stearic acid zinc film was formed on the surface of this charging roller 3101*a*, which was used as a charging roller for an image forming test with a linear velocity of 120 mm/sec (20 cpm), and in this test it was observed that the surface of the charging roller 3101*a* was little contaminated after 5K sheets of images were formed. At this point of time, the image forming apparatus was stopped, operation thereof kept down for two days with the charging roller 3101*a* contacted to the photosensitive drum 3103, and then generation of the horizontal stripes after restart of operation of the image forming apparatus was checked, and in this test it was confirmed that a number of horizontal stripes was substantially reduced as compared to a case where stearic acid zinc was not applied.

This image forming test was continued, and the surface of the roller was partially contaminated by toner after 10K sheets of images were formed, and an abnormal state suspectedly caused by uneven electrification was generated in the half-tone image, so that the charging roller 3101*a* was dismounted from the image forming apparatus, contamination of the surface of the charging roller 3101*a* was cleaned, then stearic acid zinc was again applied to the surface of the charging roller 3101*a*, the image forming test was continued, and excellent images having no fault caused by uneven electrification were obtained. As described above, the effect obtained by applying stearic acid zinc onto the surface of the charging roller 3101*a* was observed. In other words, excellent images can always be obtained if periodical maintenance is provided by appropriate persons such as a serviceman.

Although Embodiment 9 is a case where stearic acid zinc is used as a lubricant additive, also such a material as stearic acid iron or arbana wax can be used for the same purpose. However, it should be noted that the stearic acid zinc was the most effective.

Embodiment 10 is a case where a lubricant additive applying means for contacting solid state stearic acid zinc to a surface of the charging roller 3101 being used and homogeneously applying the stearic acid zinc to the surface making use of rotation of the charging roller 3101.

Figure 13:
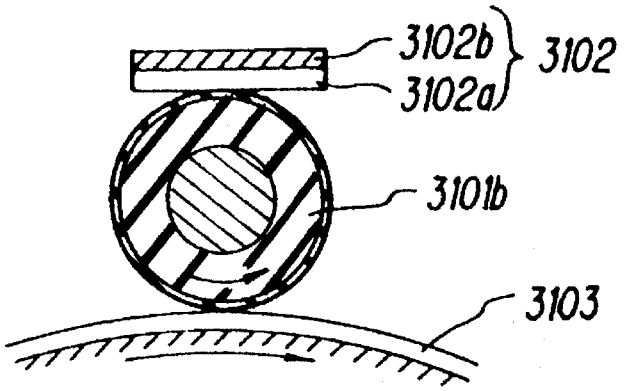
FIG. 13 is an explanatory view illustrating general configuration of a roller charging apparatus according to Embodiment 10 of the present invention.

In Embodiment 10, in the image forming apparatus shown in FIG. 11, the medium resistance elastic layer was molded as the charging roller 3101 around the core metal 3201 shown in FIG. 12B, then a charging roller 3101*b* (concretely a charging roller comprising an epichlorohydrin having a thickness of 3 mm molded around a core metal with a diameter of 8ϕ and a carbon-containing fluorine resin surface layer having a thickness of 30 μm) with the surface layer 3203 provided on this elastic layer 3202 was used, and then the solid state stearic acid zinc was provided as the lubricant additive applying means for applying stearic acid zinc as a lubricant additive onto the surface of the charging roller 3101*b* as shown in FIG. 13.

Herein the solid state stearic acid zinc 3102 is pressed by a prespecified spring mechanism (not shown) with a small pressure not interfering with the rotation of the charging roller 3101*b*. Also the solid state stearic acid zinc 3102 comprises stearic acid zinc 3102*a* and a support plate 3102*b* for supporting the stearic acid zinc 3102*a*.

With the configuration as described above, an image forming test was carried out with a linear velocity of 120 mm/sec as in Embodiment 9, and in this test it was observed that the stearic acid zinc applied on the surface of the charging roller 3101*b* was well transferred onto the surface of the photosensitive drum, said transferred stearic acid zinc making the surface of the photosensitive drum 3103 more slippy, and the cleaning capability of the drum cleaner 3107 was improved. When the surface of the photosensitive drum 3103 is well cleaned, contamination of the charging roller 3101*b* is reduced proportionately. Actually in Embodiment 10, after 20K sheets of images were formed, the charging roller 3101*b* was little contaminated, and generation of abnormal images caused by uneven electrification was not observed. Also operation of the image forming apparatus was kept down with the charging roller 3101*a* contacted to the photosensitive drum 3103 for 2 days, and then operation of the image forming apparatus was restarted and generation of horizontal stripes was checked, but no horizontal stripe was generated after restart of operation of the image forming apparatus.

Figure 14:
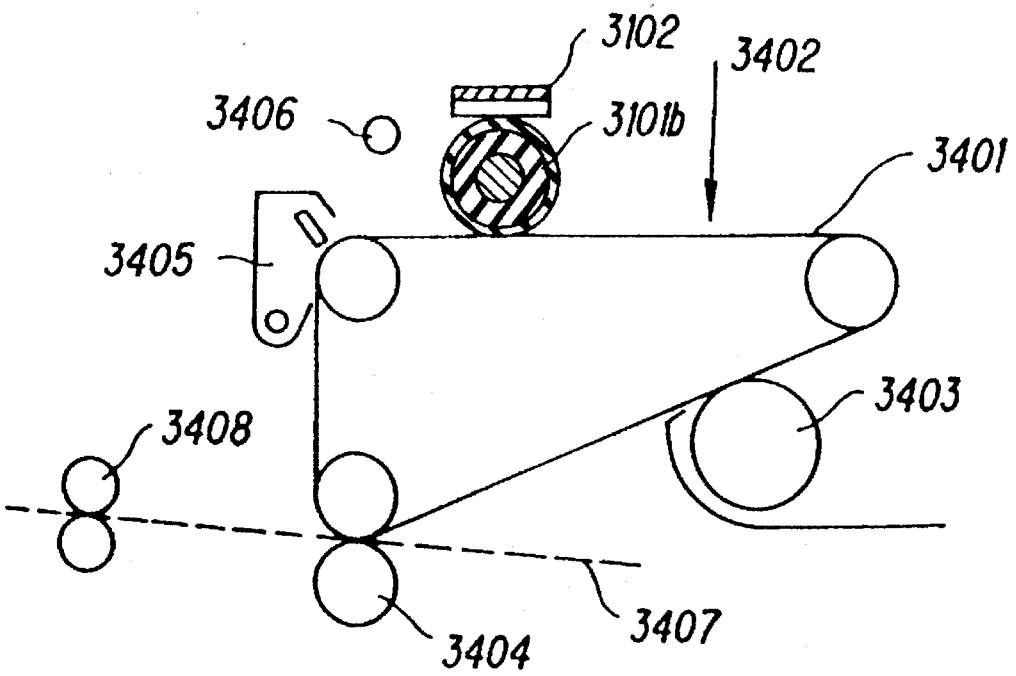
FIG. 14 is an explanatory view illustrating an example of an image forming apparatus incorporating a photosensitive belt in which a roller charging apparatus according to Embodiment 11 is applied.

Embodiment 11 is a case in which the charging roller 3101*b* and the solid state stearic acid zinc 3102 as a lubricant additive applying means were provided in an image forming apparatus using therein a photosensitive belt shown in FIG. 14. In this figure, designated at the reference numeral 3401 is a photosensitive belt, at 3402 a laser beam as exposure data for forming an electrostatic image on the photosensitive belt 3401, at 3403 a developing unit for developing the electrostatic latent image on the photosensitive belt 3401 with toner, at 3404 a transfer roller for transferring the toner image onto recording paper 3407, at 3405 a belt cleaner for removing toner remaining on the surface of the photosensitive belt 3401 after the transfer process, at 3406 an electric charge removing lamp, at 3407 recording paper, and at 3408 a fixing unit.

With the configuration as described above, an image forming test was carried out with a linear velocity of 120 mm/sec as in Embodiment 9, and in this test it was observed that the stearic acid zinc applied on the surface of the charging roller 3101*b* was well transferred onto the surface of the photosensitive drum, said transferred stearic acid zinc making the surface of the photosensitive drum 3401 more slippy, and the cleaning capability of the drum cleaner 3405 was improved. When the surface of the photosensitive drum 3401 is well cleaned, contamination of the charging roller 3101*b* is reduced proportionately. Actually in Embodiment 11, after 20K sheets of images were formed, the charging roller 3101*b* was little contaminated, and generation of abnormal images caused by uneven electrification was not observed. Also operation of the image forming apparatus was kept down with the charging roller 3101*a* contacted to the photosensitive drum 3401 for two days, and then operation of the image forming apparatus was restarted and generation of horizontal stripes was checked, but no horizontal stripe was generated after restart of operation of the image forming apparatus.

Figure 15:
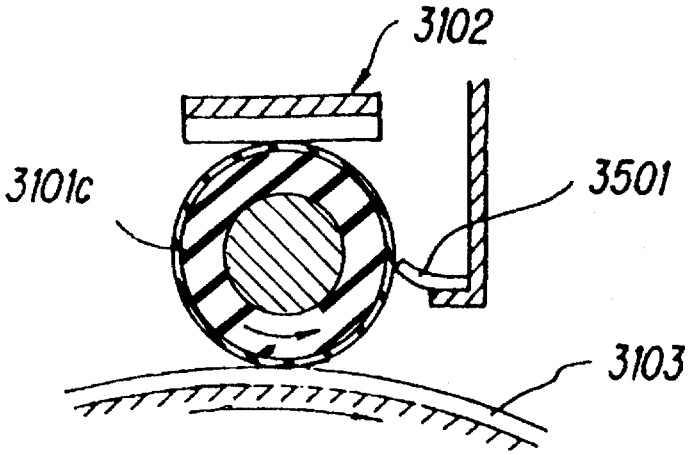
FIG. 15 is an explanatory view illustrating a roller charging apparatus according to Embodiment 12 of the present invention.
Figure 16:
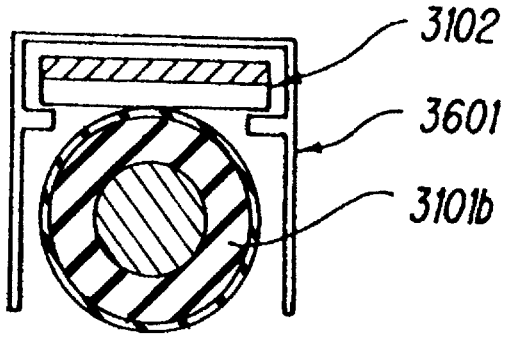
FIG. 16 is an explanatory view illustrating a roller charging apparatus according to Embodiment 13 of the present invention.

In Embodiment 12, in the image forming apparatus shown in FIG. 11, the conductive elastic layer was molded as the charging roller 3101 around the charging roller 3101 around the core metal 3201 shown in FIG. 12C, then a charging roller 3101*c* (concretely a charging roller having a diameter of 14ϕ and comprising a carbon-containing silicon rubber elastic layer having a thickness of 3 mm and molded around a core metal with a bore of 8ϕ and a carbon-containing fluorine resin surface layer having a thickness of 50 μm) with the surface resistance layer 3205 provided on this elastic layer 3204 was used, and furthermore the roller charging apparatus comprises, as shown in FIG. 15, the solid state stearic acid zinc 3102 as a lubricant additive applying means contacting the charging roller 3101*c*, and a cleaning blade 3501 for removing foreign materials such as toner deposited on the surface of the charging roller 3101*c*. It should be noted that the cleaning blade 3501 is made of urethane rubber having a thickness of 0.5 mm.

With the configuration as described above, the image forming test was carried out as in Embodiment 9, but with a linear velocity of the image forming apparatus increased to 210 mm/sec (35 cpm). In Embodiment 12, it is anticipated that the cleaning capability of the photosensitive drum 3103 drops in reverse proportion to an increase of the linear velocity and the charging roller 3101*c* is contaminated more by toner, so that the cleaning blade 3501 as described above is provided.

Under the conditions as described above, an image forming test was carried out, and after 30K sheets of images were formed, the surface of the charging roller 3101*c* was little contaminated and a drop of static voltage or uneven electrification was not observed. Also an image formed first after operation of the image forming apparatus was kept down for a long time was checked, but an abnormal image like a horizontal stripe caused by impression by the charging roller 3101*c* on the photosensitive drum 3103 was not observed.

Also as stearic acid zinc is always applied on the surface of the charging roller 3101*c*, the surface of the charging roller 3101*c* can be cleaned more easily.

In Embodiment 13 is used a frame 3601 in which the solid state stearic acid zinc as a lubricant additive applying means is supported above the charging roller 3101*b* and contacted to the charging roller 3101*b* by making use of the tare weight so that the stearic acid zinc can be applied to the surface of the charging roller 3101*b*. It should be noted that the remaining portion of the configuration is the same as that in Embodiment 10 and description thereof is omitted herein.

With the configuration as described above, the image forming test similar to that in Embodiment 10 was carried out, and the same effect as in Embodiment 10 was obtained. Also stearic acid zinc is contacted by its tare weight via the frame 3601 to the charging roller 3101*b*, so that the stearic acid zinc can homogeneously be applied to the surface of the charging roller 3101*b* with an appropriate level of pressure, which enables 3101*b*, so that the stearic acid zinc can homogeneously be applied to the surface of the charging roller 3101*b* with an appropriate level of pressure, which enables space-saving application with low cost. Also by adjusting the weight to be loaded (tare weight thereof), the application rate can freely be controlled.

Description of the Embodiments 10 to 12 assumes the configuration in which stearic acid zinc is located above a charging roller and pressure is loaded by means of such a device as a spring, but the stearic acid zinc may be located in the side of the charging roller, and also it is needless to say that the lubricant additive may be molded into a roll and contacted to the surface of the charging roller or applied via such a device as a brush onto the surface of the charging roller.

As described above, in the roller charging apparatus according to the present invention, only a DC voltage is loaded to a charging roller which contacts a photosensitive element and rotates following rotation of the photosensitive element to homogeneously electrify the surface of the photosensitive element, so that it is possible to suppress an increase of cost of the apparatus itself, an increase of power cost, and a generation of a large quantity of ozone and evade deterioration of the charging members and the photosensitive element as well as to suppress generation of environmental pollution.

Also in the roller charging apparatus according to the present invention, the charging roller is made of epichlorohydrin rubber and at the same time the roller hardness of the charging roller is 42 (measured by a JISA hardness meter) or more, homogeneous electrification can be carried out by loading only a DC voltage, and a roller charging apparatus with high durability can be realized.

Also in the roller charging apparatus according to the present invention, the charging roller has two layers of an elastic layer made of epichlorohydrin rubber and a surface layer made of polyamide resin and covering the surface of the elastic layer, and at the same time the roller hardness of the charging roller is 42 (measured by a JISA hardness meter) or more, so that homogeneous electrification can be carried out by loading only a DC voltage, and also a roller charging apparatus having a high durability can be realized.

Also in the roller charging apparatus according to the present invention, the charging roller has two layers of an elastic layer made of epichlorohydrin rubber and a surface layer made of carbon-containing fluorine resin and covering the surface of the elastic layer, and at the same time the roller hardness of the charging roller is 42 (measured by a JISA hardness meter) or more, so that homogeneous electrification can be carried out by loading only a DC voltage, and also a roller charging apparatus having a high durability can be realized. Also the charging roller can be cleaned more easily.

Also in the roller charging apparatus according to the present invention, the roller diameter $D_r$ of the charging roller and the drum diameter $D_d$ of the photosensitive drum satisfy the relation of $D_d/D_r \geqq 4$, so that an appropriate nip width can be obtained and homogeneous electrification can be carried out also in the longitudinal direction of the roller.

Also in the roller charging apparatus according to the present invention, a position where the charging roller contacts the photosensitive belt is located near a driving roller or a slave roller of the photosensitive belt, and at the same time the contact width or the nip width is 3 mm or more, so that homogeneous electrification can be carried out also in the longitudinal direction of the roller.

Also in the roller charging apparatus according to the present invention, the contact pressure $P_1$ and friction coefficient $\mu_1$ between the charging coller and the photosensitive drum and the contact pressure $P_2$ and friction coefficient $\mu_2$ between the charging roller and the cleaning blade satisfy the relations $P_1>P_2$ and $\mu_1<\mu_2$ simultaneously, so that contamination of the charging roller and generation of uneven electrification due to non-uniformed rotation can be prevented and the substantial durability of the charging roller can be improved.

Also in the roller charging apparatus according to the present invention, in order to make the rubber hardness of the charging roller higher than that of the cleaning blade, the charging roller is made of, for instance, epichlorohydrin having the rubber hardness of 40 (JISA) or more, and the cleaning blade is made of synthetic rubber having the rubber hardness of 40 (JISA) or more, so that contamination of the charging roller and generation of uneven electrification due to non-uniformed rotation can be prevented and the substantial durability of the charging roller can be improved.

Also in the roller charging apparatus according to the present invention, the surface of the charging roller is electrified to a static voltage having the same polarity as that of the developing toner, so that toner is hardly deposited on the surface of the charging roller, toner deposited on the surface of the charging roller can easily be removed, toner removal can efficiently be carried out with a small blade pressure, contamination of the charging roller by toner and generation of uneven electrification due to inhomogeneous rotation can be prevented, and the substantial durability of the charging roller can be improved.

Also in the image forming apparatus according to the present invention, the surface of the charging roller is covered with fluorine resin, and the cleaning blade is made of ethylene propylene rubber or urethane rubber, so that contamination of the charging roller by toner and generation of uneven electrification due to inhomogeneous rotation can be prevented and the substantial durability of the charging roller can be improved.

Also in the image forming apparatus according to the present invention, the surface of the charging roller is covered with polyamide resin and the cleaning blade is made of urethane rubber or ethylene propylene rubber, so that contamination of the charging roller by toner and generation of uneven electrification due to inhomogeneous rotation can be prevented, and the substantial durability of the charging roller can be improved.

In the image forming apparatus according to the present invention, the charging roller can effectively be cleaned by periodically rotating the photosensitive drum and the charging roller when image forming is not being performed, so that contamination of the charging roller by toner and generation of uneven electrification due to inhomogeneous rotation can be prevented and the substantial durability can be improved.

In the roller charging apparatus according to the present invention, on the surface of the charging roller is formed a lubricant additive film layer, so that contamination of the charging roller by toner and also generation of abnormal images such as horizontal stripes can be prevented.

The roller charging apparatus according to the present invention has a lubricant additive applying means for applying lubricant additive onto the surface of the charging roller, so that contamination of the charging roller by toner can be prevented and also generation of abnormal images such as horizontal stripes can be prevented.

Also the roller charging apparatus according to the present invention has a lubricant additive applying means in which the lubricant additive is supported above the charging roller, the lubricant additive is contacted to the charging roller making use of the tare weight and applied to the surface thereof, so that low cost and space-saving application of lubricant additive can be carried out.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A roller charging apparatus for homogeneously charging a surface of a photosensitive element by loading a DC voltage only to a charging roller made of epichlorohydrin rubber and at a same time a roller hardness of said charging roller is 42 measured by a JISA hardness meter or more, which contacts a drum-formed or a belt-formed photosensitive element and rotates.

2. A roller charging apparatus according to claim 1, wherein a roller hardness of said charging roller is 45–60 measured by a JISA hardness meter.

3. A roller charging apparatus for homogeneously charging a surface of a photosensitive element by loading a DC voltage only to a charging roller comprising an elastic layer made of epichlorohydrin and a surface layer made of polyamide resin which covers said elastic layer, and a roller hardness of said charging roller is 42 measured by a JISA hardness meter or more, which contacts a drum-formed or a belt-formed photosensitive element and rotates.

4. A roller charging apparatus according to claim 3, wherein a roller hardness of said charging roller is 45–70 measured by a JISA hardness meter.

5. A roller charging apparatus for homogeneously charging a surface of a photosensitive element by loading a DC voltage only to a charging roller comprising an elastic layer made of epichlorohydrin and a surface layer made of fluorine resin and covering a surface of said elastic layer, and a roller hardness of said charging roller is 42 measured by a JISA hardness meter or more, which contacts a drum-formed or a belt-formed photosensitive element and rotates.

6. A roller charging apparatus according to claim 5, wherein a roller hardness of said charging roller is 45–70 measured by a JISA hardness meter.

7. A roller charging apparatus according to claim 5, wherein said fluorine resin is carbon-containing fluorine resin.

8. A roller charging apparatus for homogeneously charging a surface of a photosensitive drum by loading a DC voltage only to said charging roller which contacts said photosensitive drum and rotates, and roller diameter $D_r$ of said charging roller and drum diameter $D_d$ of said photosensitive drum satisfy a relation of $D_d/D_r \geqq 4$.

9. A roller charging apparatus according to claim 8, wherein a roller hardness of said charging roller is 42 measured by a JISA hardness meter or more.

10. A roller charging apparatus for homogeneously charging a surface of said charging roller by loading a DC voltage only to said charging roller contacting a photosensitive belt and rotating with rotation of said photosensitive belt and having a roller hardness of 45 measured by a JISA hardness meter or more, and a position where said charging roller contacts a surface of said photosensitive belt is located near a driving roller or a slave roller of said photosensitive belt.

11. A roller charging apparatus according to claim 10, wherein a roller hardness of said charging roller is 50–80 measured by a JISA hardness meter.

12. A roller charging apparatus for homogeneously charging a surface of said charging roller by loading a DC voltage only to said charging roller contacting a photosensitive belt and rotating with rotation of said photosensitive belt and having a roller hardness of 45 measured by a JISA hardness meter or more, and a position where said charging roller contacts said photosensitive belt is located near a driving roller or a slave roller of said photosensitive belt, and a contact width or nip width is 3 mm or more.

13. A roller charging apparatus according to claim 12, wherein a roller hardness of said charging roller is 50–80 measured by a JISA hardness meter.

14. A roller charging apparatus comprising:

a charging roller which contacts at least a photosensitive element and rotates; and a cleaner for removing foreign materials such as toner deposited on a surface of said charging roller;

wherein a contact pressure $P_1$ and friction coefficient $\mu_1$ between said charging roller and said photosensitive element and a contact pressure $P_2$ and friction coefficient $\mu_2$ between said charging roller and said cleaner satisfy a relations of $P_1 > P_2$ and $\mu_1 < \mu_2$ simultaneously.

15. A roller charging apparatus according to claim 14, wherein said cleaner is a cleaning blade.

16. A roller charging apparatus comprising:

a charging roller which contacts at least a photosensitive element and rotates; and a cleaner for removing foreign materials such as toner deposited on a surface of said charging roller;

wherein a rubber hardness of said charging roller is higher than that of said cleaner.

17. A roller charging apparatus according to claim 16, wherein said cleaner is a cleaning blade.

18. A roller charging apparatus according to claim 16, wherein said rubber hardness of said charging roller is 40 JISA, and said rubber hardness of said cleaner is 35 JISA.

19. A roller charging apparatus comprising:

a charging roller which contacts at least a photosensitive element and rotates; and a cleaning blade for removing foreign materials such as toner deposited on a surface of said charging roller;

wherein said charging roller is made of epichlorohydrin rubber having a rubber hardness of 40 JISA or more and said cleaning blade is made of synthetic rubber having a rubber hardness of 40 JISA or less.

20. A roller charging apparatus comprising:

a charging roller which contacts at least a photosensitive element and rotates; and a cleaner for removing foreign materials such as toner deposited on a surface of said charging roller;

wherein said charging roller is made of epichlorohydrin rubber having a rubber hardness of 45 JISA or more and said cleaner comprising a cleaning blade made of synthetic rubber having a rubber hardness of 45 JISA or less.

21. A roller charging apparatus comprising:

a charging roller which contacts at least a photosensitive element and rotates; and a cleaner for removing foreign materials such as toner deposited on a surface of said charging roller;

wherein a surface of said charging roller has a same polarity as that of developing toner due to friction between said charging roller and said cleaner.

22. A roller charging apparatus according to claim 21, wherein said cleaner is a cleaning blade.

23. An image forming apparatus comprising:

a roller charging apparatus having a charging roller which contacts at least a photosensitive element and rotates and a cleaner for removing foreign materials such as toner deposited on a surface of said charging roller;

an exposure device for exposing a surface of a photosensitive element charged to a negative static voltage by said charging roller;

a developing device for inserting and developing latent images formed on said photosensitive element with toner having a negative polarity;

a transfer device for transferring visual images formed by said developing device to recording paper; and a cleaning device for cleaning a surface of said photosensitive element with a cleaning member after transfer by said transfer device is finished;

wherein a surface of said charging roller is covered with fluorine resin and said cleaner is made of ethylene propylene rubber or urethane rubber.

24. A roller charging apparatus according to claim 23, wherein said cleaner is a cleaning blade.

25. An image forming apparatus comprising:

a roller charging apparatus having a charging roller which contacts at least a photosensitive element and rotates and a cleaner for removing foreign materials such as toner deposited on a surface of a charging roller;

an exposure device for exposing a surface of a photosensitive element charged to a negative static voltage by said charging roller, a developing device for inserting and developing latent images formed on said photosensitive element with toner having a positive polarity;

a transfer device for transferring visual images formed by said developing device to recording paper; and a cleaning device for cleaning a surface of said photosensitive element with a cleaning member after transfer by said transfer device is finished;

wherein a surface of said charging roller is covered with polyamide resin and said cleaner is made of urethane rubber or ethylene propylene rubber.

26. A roller charging apparatus according to claim 25, wherein said cleaner is a cleaning blade.

27. An image forming apparatus comprising:

a charging roller which contacts at least a photosensitive element and rotates; and a roller charging apparatus having a cleaner for removing foreign materials such as toner deposited on a surface of said charging roller;

wherein said photosensitive element and said charging roller are periodically rotated when image forming is not being performed.

28. A roller charging apparatus according to claim 27, wherein said cleaner is a cleaning blade.

29. A roller charging apparatus which charges a photosensitive drum or a photosensitive belt by loading a voltage to a charging roller which contacts a surface of said photosensitive drum or said photosensitive belt and rotates, and a lubricant additive film layer is formed on a surface of said charging roller.

30. A roller charging apparatus according to claim 29, wherein said lubricant additive is stearic acid zinc.

31. A roller charging apparatus which charges a photosensitive drum or a photosensitive belt by loading a voltage to a charging roller which contacts a surface of said photosensitive drum or said photosensitive belt and rotates, having a lubricant additive applying device for applying lubricant additive onto a surface of said charging roller.

32. A roller charging apparatus according to claim 31, wherein said lubricant additive is stearic acid zinc.

33. A roller charging apparatus according to claim 31, wherein said lubricant additive applying device has a configuration in which said lubricant additive is supported above the charging roller and is contacted to said charging roller making use of tare weight of said lubricant additive to applying said lubricant additive onto a surface of said charging roller.

* * * * *